US008040339B2

(12) United States Patent
Chaussy et al.

(10) Patent No.: US 8,040,339 B2
(45) Date of Patent: Oct. 18, 2011

(54) OPTIMIZED ROWOFF VOLTAGE

(75) Inventors: Danika Chaussy, Brie et Angonnes (FR); Céline Mas, Poisat (FR)

(73) Assignee: STMicroelectronics S.A., Montrouge (FR)

( * ) Notice: Subject to any disclaimer, the term of this patent is extended or adjusted under 35 U.S.C. 154(b) by 1102 days.

(21) Appl. No.: 11/753,892

(22) Filed: May 25, 2007

(65) Prior Publication Data

US 2008/0030442 A1 Feb. 7, 2008

(30) Foreign Application Priority Data

Aug. 3, 2006 (EP) ..... 06300858

(51) Int. Cl.
*G09G 3/32* (2006.01)

(52) U.S. Cl. ..... 345/211

(58) Field of Classification Search ..... 345/76, 345/82, 98, 211; 315/167
See application file for complete search history.

(56) References Cited

U.S. PATENT DOCUMENTS

| | | | | |
|---|---|---|---|---|
| 6,256,025 | B1 * | 7/2001 | Imai et al. | 345/211 |
| 7,078,864 | B2 * | 7/2006 | Kudo et al. | 315/169.1 |
| 7,847,796 | B2 * | 12/2010 | Shin et al. | 345/210 |
| 7,893,907 | B2 * | 2/2011 | Kang | 345/94 |
| 2004/0061672 | A1 * | 4/2004 | Page et al. | 345/82 |
| 2004/0189573 | A1 * | 9/2004 | Lee et al. | 345/94 |
| 2004/0207329 | A1 * | 10/2004 | Kudo et al. | 315/167 |
| 2006/0001613 | A1 * | 1/2006 | Routley et al. | 345/76 |
| 2006/0007095 | A1 * | 1/2006 | Kudo et al. | 345/98 |
| 2006/0170641 | A1 * | 8/2006 | Song et al. | 345/98 |
| 2007/0024554 | A1 * | 2/2007 | Ko | 345/87 |

OTHER PUBLICATIONS

European Search Report from corresponding European Application No. 06300858, filed Aug. 3, 2006.

Danika Chaussy et al., *New OLED Driver IC Optimizes Module Power Consumption, Image Quality, Reliability, and Cost*, 2006 SID International Symposium Digest of Technical Papwrs, San Francisco, CA Jun. 4-6, 2006, pp. 406-409, XP002413381.

* cited by examiner

*Primary Examiner* — Quan-Zhen Wang
*Assistant Examiner* — Tony Davis
(74) *Attorney, Agent, or Firm* — Lisa K. Jorgenson; James H. Morris; Wolf, Greenfield & Sacks, P.C.

(57) ABSTRACT

Circuitry for controlling a display matrix formed of light-emitting diodes arranged in rows and columns, diodes in each row being connected to common row lines, and diodes in each column being connected to common column lines, each of the column lines being selectively connected to a current source for providing a current to each of the column lines when the column line is selected, a column voltage being present at a column node of each column line while the column line is selected, each of the row lines being selectively connected to a rowoff voltage for turning off the diodes in that row, the circuitry including circuitry for generating the rowoff voltage including: capture circuitry arranged to capture a maximum value of the column voltages present at the column nodes of a plurality of selected column lines; storage circuitry arranged to store the maximum column voltage; and output circuitry arranged to provide the rowoff voltage based on the maximum column voltage.

20 Claims, 6 Drawing Sheets

OPTIMIZED ROWOFF VOLTAGE

FIELD OF THE INVENTION

The present invention relates to electroluminescent display matrixes formed of light-emitting diodes. The diodes are, for example, organic diodes or polymer diodes. In particular, the present invention relates to the generation of an optimized rowoff voltage level.

BACKGROUND OF THE INVENTION

FIG. 1 illustrates an example of a matrix display 100 comprising a number of light-emitting diodes 102. The diodes 102 are arranged in a number of columns and rows and each diode is connected between a column line 104 and a row line 106 associated with each column and row respectively. In particular, the cathodes of diodes 102 in a same row are connected to one of the row lines 106, and the anodes of diodes 102 in a same column are connected to one of the column lines 104.

Each column line 104 is connected to a respective current source 108, providing a determined current to the column line via a respective column switch 110. Column switches 110 selectively connect each column line to either the current source 108, or to a ground node, labelled GND in FIG. 1.

Each row line 106 is selectively connected to a rowoff voltage 112 via a respective row switch 114. Row switches 114 allow each row line 106 to be connected to one of the rowoff voltage or a ground node GND.

In operation, columns will be activated by switching column switches 110 such that selected current sources 108 are connected to respective column lines 104. Rows are successively selected by selectively connecting row lines 106 to the ground nodes using row switches 114. It is ensured that the diodes of unselected row lines remain switched off by connecting the cathodes of these diodes to the rowoff voltage 112 via their respective row line.

In the circuit of FIG. 1, the rowoff voltage is a fixed voltage, which is sufficiently high to ensure that the diodes of the row connected to this voltage are always off. A disadvantage of the circuit of FIG. 1 is that due to the necessarily high voltages applied to the cathodes of each of the diodes, the lifetime of these diodes is significantly reduced by high reverse biasing.

SUMMARY OF THE INVENTION

Embodiments of the present invention aim to at least partially address the above-mentioned disadvantages in the prior art.

According to a first embodiment of the present invention there is provided circuitry for controlling a display matrix formed of light-emitting diodes arranged in rows and columns, diodes in each row being connected to common row lines, and diodes in each column being connected to common column lines, each of said column lines being selectively connected to a current source for providing a current to each of said column lines when said column line is selected, a column voltage being present at a column node of each column line while said column line is selected, each of said row lines being selectively connected to a rowoff voltage for turning off the diodes in that row, the circuit comprising generating means for generating said rowoff voltage comprising: capture circuitry arranged to capture a maximum value of the column voltages present at the column nodes of a plurality of selected column lines; storage circuitry arranged to store said maximum column voltage; output circuitry arranged to provide said rowoff voltage based on said maximum column voltage; and voltage offsetting circuitry arranged to offset said maximum column voltage to provide said rowoff voltage, wherein said voltage offsetting circuitry provides a plurality of possible rowoff voltages, each being offset from said maximum column voltage by a different fixed amount, and selecting circuitry for selecting one of said possible rowoff voltages as the rowoff voltage.

According to some embodiments the above circuitry is also arranged to generate a precharge voltage and a supply voltage based on said maximum column voltage.

According to a further aspect of the present invention, there is provided a method for controlling a display matrix formed of light-emitting diodes arranged in rows and columns, diodes in each row being connected to common row lines, and diodes in each column being connected to common column lines, each of said column lines being selectively connected to a current source for providing a current to each of said column lines when said column line is selected, a column voltage being present at a column node of each selected column line while said column line is selected, each of said row lines being selectively connected to a rowoff voltage for turning off the diodes in that row, the method comprising generating said rowoff voltage comprising the steps of: capturing a maximum value of the column voltages present at the column nodes of selected column lines; storing said maximum column voltage; and providing said rowoff voltage based on said maximum column voltage, wherein providing said rowoff voltage comprises offsetting said maximum column voltage by a selected one of a plurality of possible rowoff voltages, each possible rowoff voltage being a voltage value offset from said maximum column voltage by a different fixed amount.

BRIEF DESCRIPTION OF THE DRAWINGS

The foregoing and other features, aspects and advantages of the invention will become apparent from the following detailed description of embodiments, given by way of illustration and not limitation with reference to the accompanying drawings, in which.

DETAILED DESCRIPTION

Figure 1:
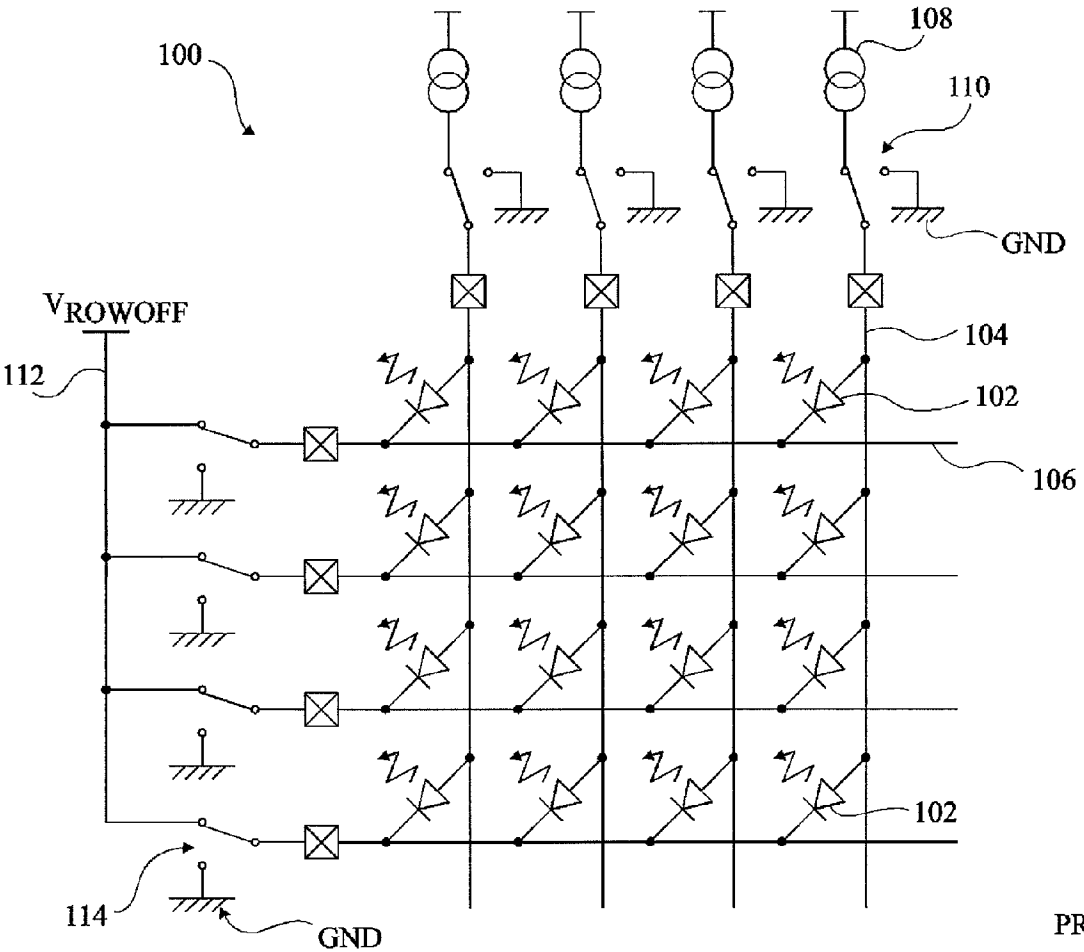
Fig 1 PRIOR ART
FIG. 1, described above, illustrates a known display matrix with light-emitting diodes.
Figure 2:
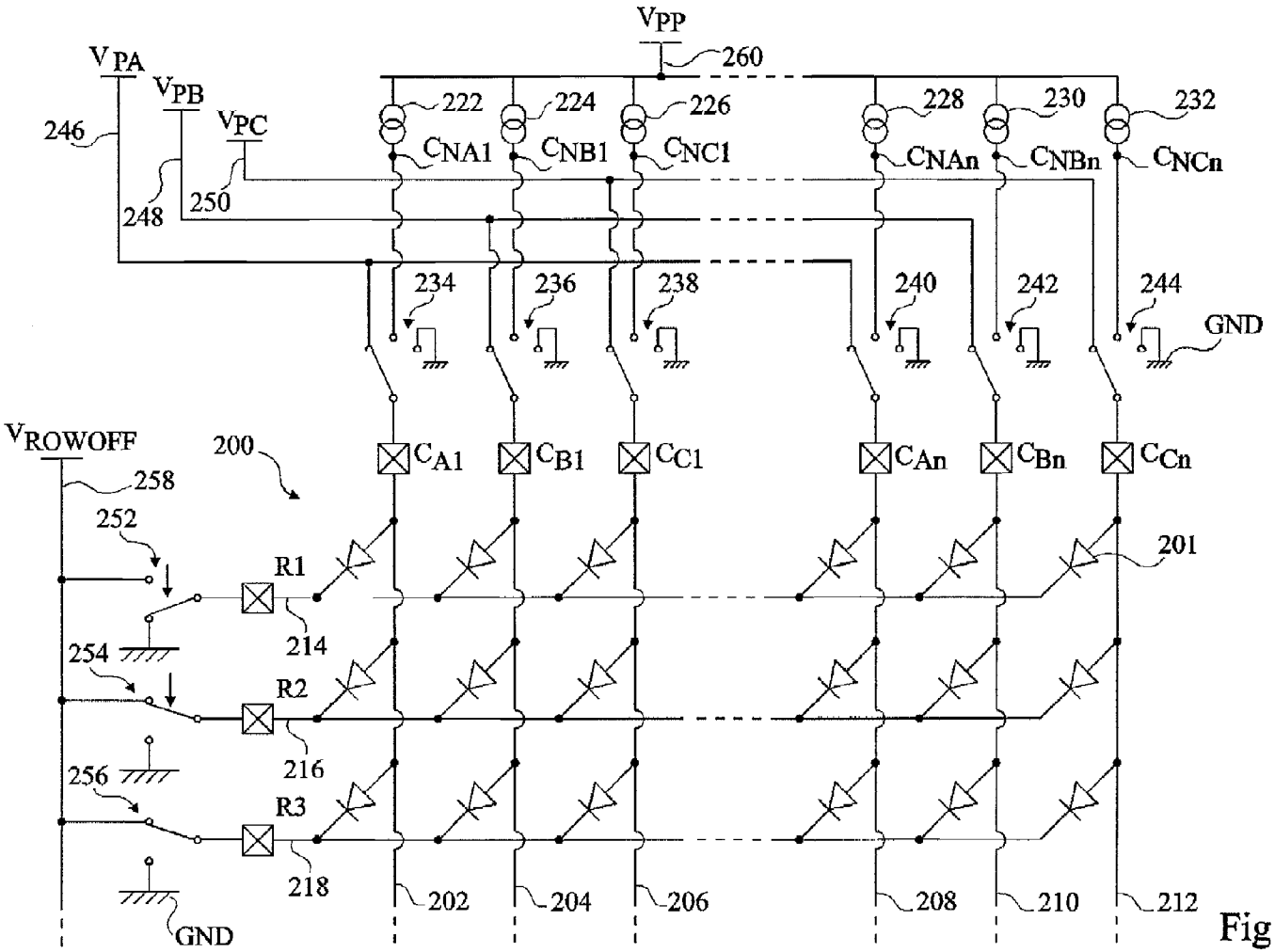
FIG. 2 illustrates a display matrix comprising light-emitting diodes according to one embodiment.

FIG. 2 illustrates a display matrix 200 which is similar to display matrix 100 described above. In particular, it comprises rows and columns of diodes 201, each of the diodes 201 being a light-emitting diode, for example an organic diode or a polymer diode.

In the display matrix of FIG. 2, the anode of each diode in a particular column is connected to a respective column line, and six such column lines are represented in FIG. 2, these being the first three column lines $C_{A1}$, $C_{B1}$, $C_{C1}$ in the matrix which are labelled 202, 204 and 206 respectively, and the last three column lines $C_{An}$, $C_{Bn}$, $C_{Cn}$ in the matrix which are labelled 208, 210 and 212 respectively. Column lines $C_{A1}$ and $C_{An}$ are connected to respective columns of diodes of a first color A. Column lines $C_{B1}$ and $C_{Bn}$ are connected to respective columns of diodes of a second color B. Column lines $C_{C1}$ and $C_{Cn}$ are connected to respective columns of diodes of a third color C. Colors A, B and C are for example red, green and blue respectively. The matrix comprises further columns as indicated by the dashed lines, and in particular a further n-2 columns of each color, and thus n columns of each color in total. n for example equals 132, the matrix comprising 396 columns in total. The n columns are arranged such that the colors alternate throughout the matrix in the same way as shown for the first columns $C_{A1}$, $C_{B1}$, $C_{C1}$ and the last columns $C_{An}$, $C_{Bn}$, $C_{Cn}$.

The cathode of each diode 201 in a particular row is connected to a row line, three of which are shown in FIG. 2, labelled 214, 216 and 218. The matrix comprises further rows not shown in FIG. 2, again as indicated by the dashed lines in FIG. 2. The matrix for example comprises 162 rows in total.

Switches 234, 236, 238, 240, 242 and 244 are provided allowing each column line 202 to 212 to be selectively connected to one of an associated precharge voltage $V_{PA}$, $V_{PB}$, $V_{PC}$, a respective current source 222, 224, 226, 228, 230, 232, or a ground node GND. The associated precharge voltage for column lines connected to color A diodes is a first precharge voltage $V_{PA}$ on line 246, the associated precharge voltage for column lines connected to color B diodes is a second precharge voltage $V_{PB}$ on line 248, and the associated precharge voltage for column lines connected to color C diodes is a third precharge voltage $V_{PC}$ on line 250. For example, the first column $C_{A1}$ is selectively connectable to one of the first precharge voltage $V_{PA}$ via line 246, current source 222 and ground GND.

The current sources 222 to 232 are, for example, current mirrors, and are connected to a supply voltage line $V_{PP}$ on line 260.

Each of the row lines 214 to 218 is connected to a respective switch 252 to 256 which allows the respective row line to be connected to one of a variable voltage $V_{rowoff}$ on line 258 and to ground GND.

Operation of the circuit of FIG. 2 will now be described. Each of the diodes 201 in the display matrix has an intrinsic capacitance. This means that when a driving current is provided by the current sources 222 to 232 to each column line, there is an initial period in which the intrinsic capacitance associated with each of the diodes in the column is charged prior to the drive current driving the selected column diode. In order to avoid this delay, the column lines of the display matrix are precharged prior to being activated. This is accomplished by connecting the column lines to a respective precharge voltage for a period prior to their activation. Thus column switches 234 to 244 are first controlled to connect each column line to the associated precharge voltage.

At the end of the precharge period, each column line is connected via a respective column switch 234 to 244 to the associated current source 222 to 232 which injects a current to that column line for a determined period. At the same time, rows of diodes are activated successively. For example, row R1 connected to line 214 is for example activated by connecting line 214 to ground via switch 252. All the other rows that are not selected are deactivated by connecting these row lines to the voltage value $V_{rowoff}$ on line 258. For example while row R1 is activated, rows R2 and R3 are deactivated by connecting lines 216, 218 to line 258 via switches 254, 256 respectively. Thus only one row is active at a time. In the current embodiment the value of $V_{rowoff}$ is variable. Generation of $V_{rowoff}$ will now be described in more detail with reference to FIG. 3.

Figure 3:
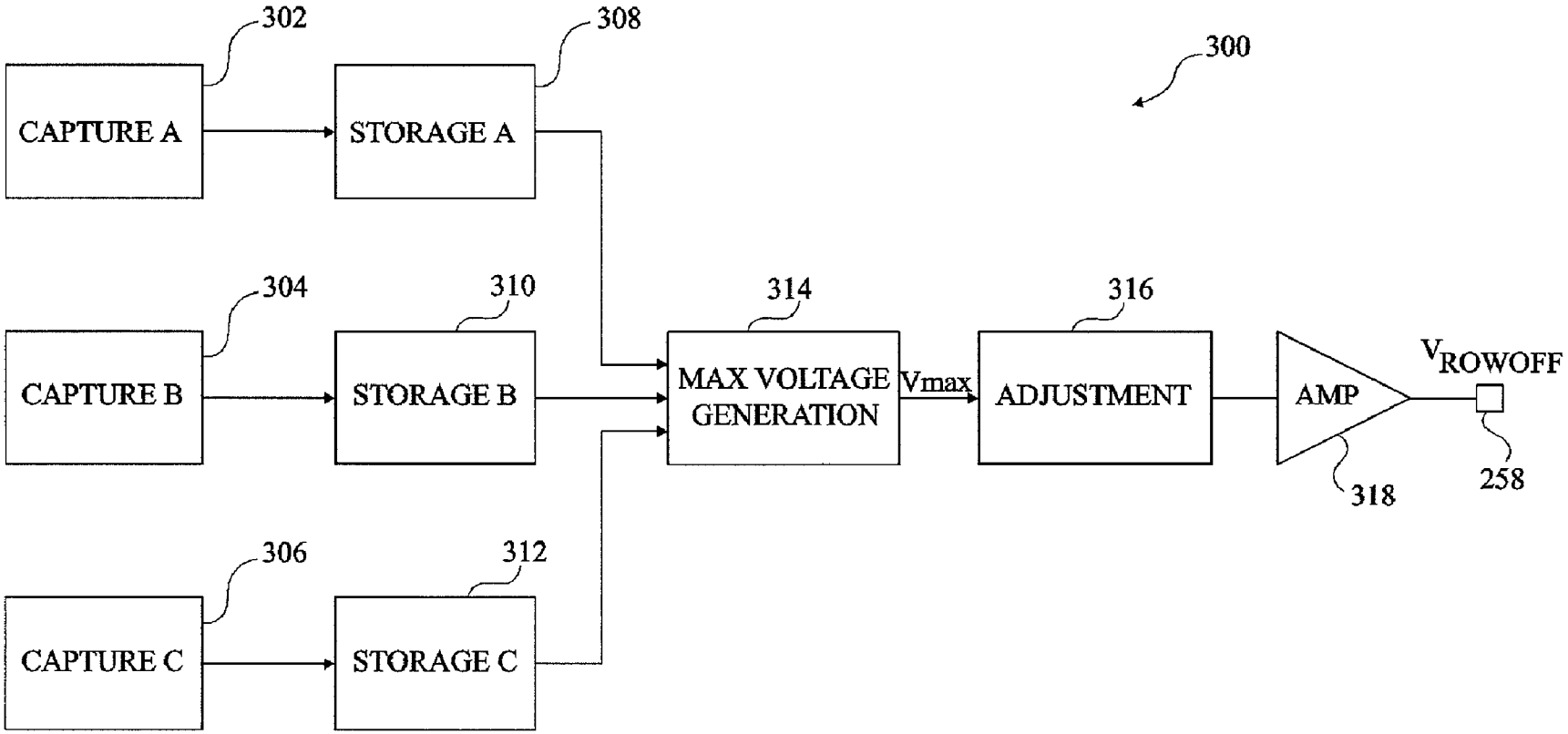
FIG. 3 illustrates circuitry for generating a rowoff voltage according to a first embodiment of the present invention.

FIG. 3 illustrates circuitry 300 for generating the rowoff voltage $V_{rowoff}$. The circuitry comprises three capture blocks 302, 304 and 306 for capturing a column voltage associated with columns of diodes of colors A, B and C, respectively. For example, capture block A 302 captures a column voltage associated with the columns of display matrix 200 having diodes of color A. The value captured by each of the capture blocks 302 to 306 is stored in a respective storage block 308, 310, 312. A maximum voltage generation block 314 then determines the maximum of these stored voltage values, and provides this value as $V_{max}$ to an adjustment circuit block 316. Adjustment circuit block 316 adjusts the voltage maximum value, and provides this value to an amplifier 318, for example an amplifier with unitary gain having a high input impedance and low output impedance, for example an operational amplifier, which provides the signal as the $V_{rowoff}$ voltage signal on line 258 to the display matrix.

Figure 4:
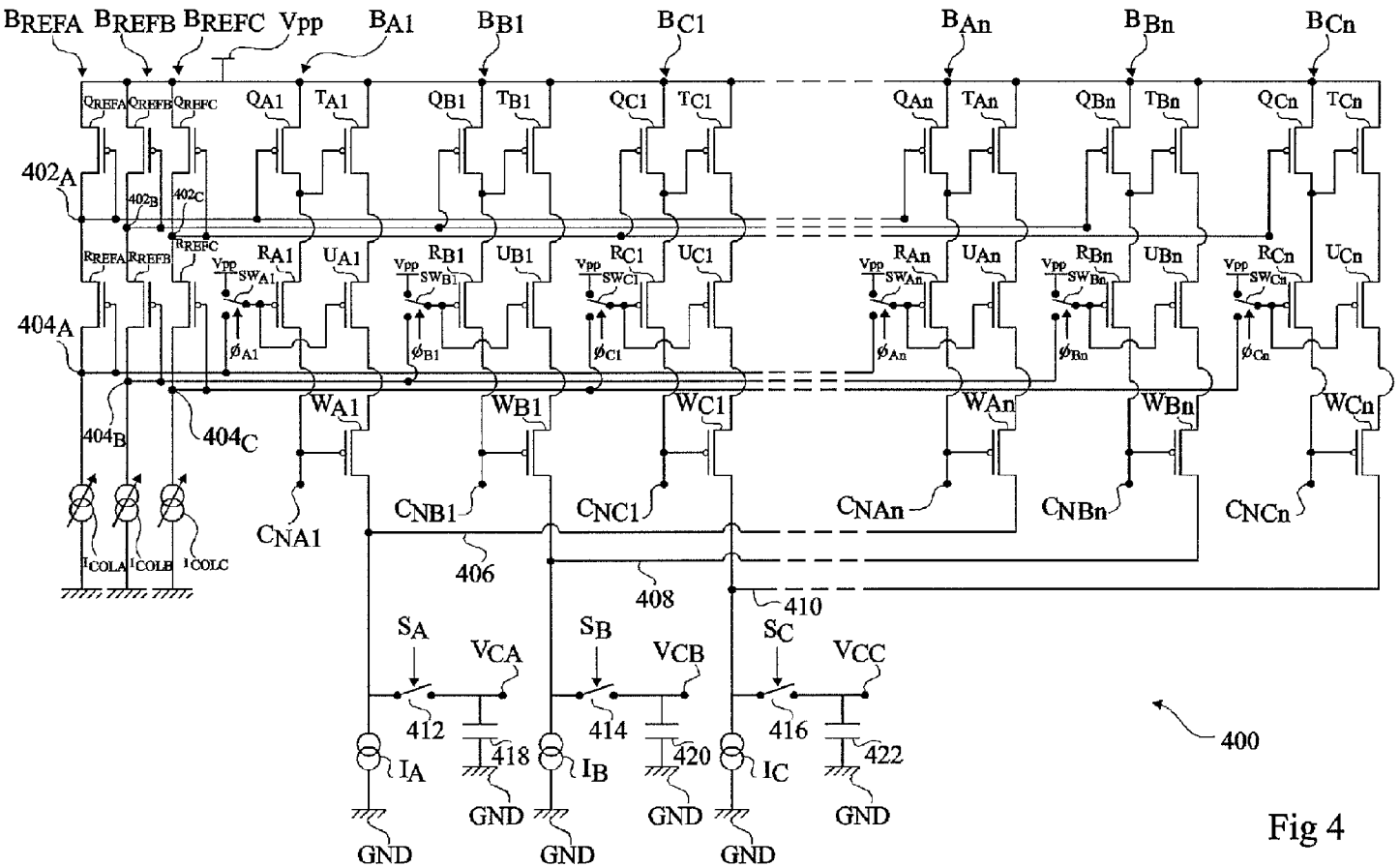
FIG. 4 illustrates the capture and storage blocks of FIG. 3 in more detail according to the first embodiment of the present invention.

FIG. 4 illustrates circuitry 400 implementing the capture and storage circuit blocks 302 to 312 of FIG. 3, which also includes the current sources for driving each of the column lines of the display matrix.

Circuitry 400 comprises a number of current mirrors having three common reference branches $B_{refA}$, $B_{refB}$, $B_{refC}$, one for the column lines of each color A, B and C, and a number of current mirror branches $B_{A1}$, $B_{B1}$, $B_{C1}$ to $B_{An}$, $B_{Bn}$, $B_{Cn}$, each branch corresponding to one of the respective current sources 222 to 232 of FIG. 2, and thus to a respective column $C_{A1}$, $C_{B1}$, $C_{C1}$ to $C_{An}$, $C_{Bn}$, $C_{Cn}$ of the display matrix 200. As previously, n is the total number of columns of each color.

The reference branches $B_{refx}$ comprises a first transistor $Q_{refx}$ and a second transistor $R_{refx}$ connected in series via their main current terminals between a supply voltage node $V_{PP}$ and a variable current source $I_{colx}$. "x" is used here and throughout the present specification to generally designate any of the color A, B or C circuitry, which are identical to each other. A first main current terminal of transistor $Q_{refx}$ is connected to $V_{PP}$, a second main current terminal of transistor $Q_{refx}$ is connected to a first main current terminal of transistor $R_{refx}$, this node labelled $\mathbf{402}_x$, and a second main current terminal of transistor $R_{refx}$ is connected to a node $\mathbf{404}_x$ which is also connected to the variable current source $I_{colx}$. $I_{colx}$ is connected between node $\mathbf{404}_x$ and a ground node GND. The gate terminal of transistor $Q_{refx}$ is connected to node $\mathbf{402}_x$. The gate terminal of transistor $R_{refx}$ is connected to node $\mathbf{404}_x$.

For example, reference branch $B_{refA}$ comprises transistors $Q_{refA}$ and $R_{refA}$ connected in series between a supply voltage node $V_{PP}$ and variable current source $I_{colA}$. A first main current terminal of transistor $Q_{refA}$ is connected to $V_{PP}$, a second main current terminal of transistor $Q_{refA}$ is connected to a first main current terminal of transistor $R_{refA}$, at node $\mathbf{402}_A$, and a second main current terminal of transistor $R_{refA}$ is connected to node $\mathbf{404}_A$ which is also connected to variable current source $I_{colA}$. $I_{colA}$ is connected between node $\mathbf{404}_A$ and a ground node GND. The gate terminal of transistor $Q_{refA}$ is connected to node $\mathbf{402}_A$, while the gate terminal of transistor $R_{refA}$ is connected to node $\mathbf{404}_A$.

Each current mirror branch $B_{A1}$, $B_{B1}$, $B_{C1}$, to $B_{An}$, $B_{Bn}$, $B_{Cn}$ comprises first and second transistors $Q_x$ and $R_x$. In particular, each of the color A column branches comprises a first transistor $Q_{A1}$ to $Q_{An}$, and a second transistor $R_{A1}$ to $R_{An}$, each of the color B column branches comprises a first transistor $Q_{B1}$ to $Q_{Bn}$, and a second transistor $R_{B1}$ to $R_{Bn}$ and each of the color C column branches comprises a first transistor $Q_{C1}$ to $Q_{Cn}$, and a second transistor $R_{C1}$ to $R_{Cn}$.

Transistors $Q_x$ and $R_x$ are connected in series via their main current terminals between the supply voltage $V_{PP}$ and a column node $C_{Nx}$ associated with each of the columns. For example, transistor $Q_{A1}$ has a first main current terminal connected to supply voltage $V_{PP}$, a second main current terminal connected to a first main current terminal of transistor $R_{A1}$, and transistor $R_{A1}$ has a second main current terminal connected to node $C_{NA1}$. Nodes $C_{NA1}$, $C_{NB1}$, $C_{NC1}$ to $C_{NAn}$, $C_{NBn}$, $C_{NCn}$ are also shown in FIG. 2, and are connected to respective switches 234 to 244 associated with each column, which are not shown in FIG. 4.

The first transistor $Q_{x1}$ in each of the branches has its gate terminal connected to node $\mathbf{402}_x$. The second transistor $R_x$ in each branch has its gate terminal connected to a respective switch $SW_{A1}$, $SW_{B1}$, $SW_{C1}$ to $SW_{An}$, $SW_{Bn}$, $SW_{Cn}$. Switches $SW_x$ allow the gate terminal of the second transistor Rx to be connected to either $V_{PP}$ or to node $\mathbf{404}_x$. For example, transistor $Q_{A1}$ has its gate terminal connected to node $\mathbf{402}_A$, and transistor $R_{A1}$ has its gate terminal connected to switch $SW_{A1}$. Switch $SW_{A1}$ allows the gate terminal of the second transistor $R_{A1}$ to be connected to either $V_{PP}$ or to node $\mathbf{404}_A$. Switches $SW_x$ are each controlled by a corresponding signal $\phi_{x1}$ to $\phi_{xn}$. For example, switch $SW_{A1}$ receives control signal $\phi_{A1}$. Signals $\phi$x represent the video coding of the pixels of the display.

Circuitry 400 comprises additional MOSFET transistors associated with each of the branches for capturing a voltage at each of the column nodes $C_{Nx}$, and determining the maximum voltage at the column nodes associated with each color A, B and C. For this, three MOSFET transistors $T_x$, $U_x$ and $W_x$ associated with each current mirror branch are provided connected in series between supply voltage $V_{PP}$ and one of three current sources $I_A$, $I_B$ and $I_C$. Transistor $T_x$ has a first main current terminal connected to supply voltage $V_{PP}$ and a second main current terminal connected to a first main current terminal of transistor $U_x$. Transistor $U_x$ has a second main current terminal connected to a first main current terminal of transistor $W_x$. Transistor $W_x$ has a second main current terminal connected to one of the three current sources $I_A$, $I_B$ and $I_C$, via a respective line 406, 408, 410. The gate terminal of transistor $T_x$ is connected to the second main current terminal of transistor $Q_x$ of the same branch. The gate terminal of transistor $U_x$ is connected to the gate terminal of transistor $R_x$ in the same branch. The gate terminal of transistor $W_x$ is connected to column node $C_{Nx}$ of the same branch.

For example, with reference to the first branch $B_{A1}$ associated with color A diodes, transistor $T_{A1}$ has its first main current terminal connected to $V_{PP}$, and its second main current terminal connected to the first main current terminal of transistor $U_{A1}$. Transistor $U_{A1}$ has its second main current terminal connected to the first main current terminal of transistor $W_{A1}$. Transistor $W_{A1}$ has its second main current terminal connected to line 406 and to the first current source $I_A$. The gate terminal transistor $T_{A1}$ is connected to the second main current terminal of transistor $Q_{A1}$. The gate terminal of transistor $U_{A1}$ is connected to the gate terminal of transistor $R_{A1}$, and the gate terminal of transistor $W_{A1}$ is connected to column node $CN_{A1}$.

The second main current terminal of each of the transistors $W_A$ associated with the color A column branches is connected to the current source $I_A$ via line 406, whilst the second main current terminal of each of the transistors $W_B$ associated with the color B column branches is connected to the second current source $I_B$ via line 408, and the second main current terminal of each of the transistors $W_C$ associated with the color C is connected to the third current source $I_C$ via line 410. Thus line 406 is a common line for all color A columns, line 408 is a common line for all color B columns, and line 410 is a common line for all color C columns.

The color A column transistors $W_A$ are connected having a common source node, and thus the voltage on line 406 represents the maximum voltage present at any of the color A column nodes $C_{NA}$. Likewise, the voltages on lines 408 and 410 represents the maximum voltage present at any of the color B and color C column nodes $C_{NB}$, $C_{NC}$, respectively.

The voltages on lines 406, 408, 410 are captured by first, second and third sampling switches 412, 414 and 416, respectively. In particular, line 406 is connected to a first terminal of a first sampling switch 412, the second terminal of switch 412 being connected to a node $V_{CA}$ representing the maximum column voltage present at the color A nodes $C_{NA}$. Node $V_{CA}$ is also connected to a first terminal of a capacitor 418, the second terminal of capacitor 418 being connected to ground. Capacitor 418 stores, at node $V_{CA}$, the voltage value sample from line 406. In a similar fashion, lines 408 and 410 are connected to nodes $V_{CB}$ and $V_{CC}$, respectively via respective sampling switches 414 and 416. Nodes $V_{CB}$ and $V_{CC}$ are also connected to capacitors 420 and 422, which store the voltage value sample on lines 408 and 410 respectively. Thus switches 412 to 416 and capacitors 418 to 422 provide a sample and hold function used to store the maximum voltage of each color column line.

In operation, whilst each row of the display matrix 200 is activated, in other words, whilst one of the row lines is connected by one of the row switches to ground, for example by row switches 252, 254 and 256 of FIG. 2, and whilst the column lines $C_A$, $C_B$ and $C_C$ are connected by respective column switches to respective current mirror branches $B_A$, $B_B$, and $B_C$, for example by switches 234 to 244 of FIG. 2, current will be driven through each of the diodes 201 of the activated row for a period determined by the signal $\phi_x$ provided to each of the current branches. In particular, whilst signal $\phi_x$ is high for a particular column branch, the switch $SW_{Ax}$ connects the gate terminal of the associated transistor R to common node $\mathbf{404}_x$, thus switching transistor $R_x$ on, and allowing current to be driven to that column line of the display matrix. However, when $\phi_x$ is made low, switch $SW_x$ will connect the gate terminal of transistor $R_x$ to $V_{PP}$, thus switching transistor $R_x$ off, and the associated column line will no longer be injected with current. During the period that $\phi_x$ is high for all of the current branches $B_x$, the voltages on lines 406, 408 and 410 are captured by providing, for a determined period, appropriate signals $S_A$, $S_B$ and $S_C$ to the sampling switches 412, 414 and 416, thus closing these switches so that the voltages are captured and stored by capacitors 418, 420 and 422 respectively. It should be noted that after current flow starts in each column line, for an initial period the column voltage $V_C$ at each column node $C_{Nx}$ will rise before settling at a stable voltage, and thus the column voltage $V_C$ is preferably sampled after this initial period.

These captured voltages $V_{CA}$, $V_{CB}$ and $V_{CC}$ thus represent the maximum voltages present at the color A, color B and color C column nodes $C_{NA}$, $C_{NB}$ and $C_{NC}$ respectively, and thus at the cathodes of the diodes 201 in the respective columns, whilst these columns are driven with current.

Figure 5:
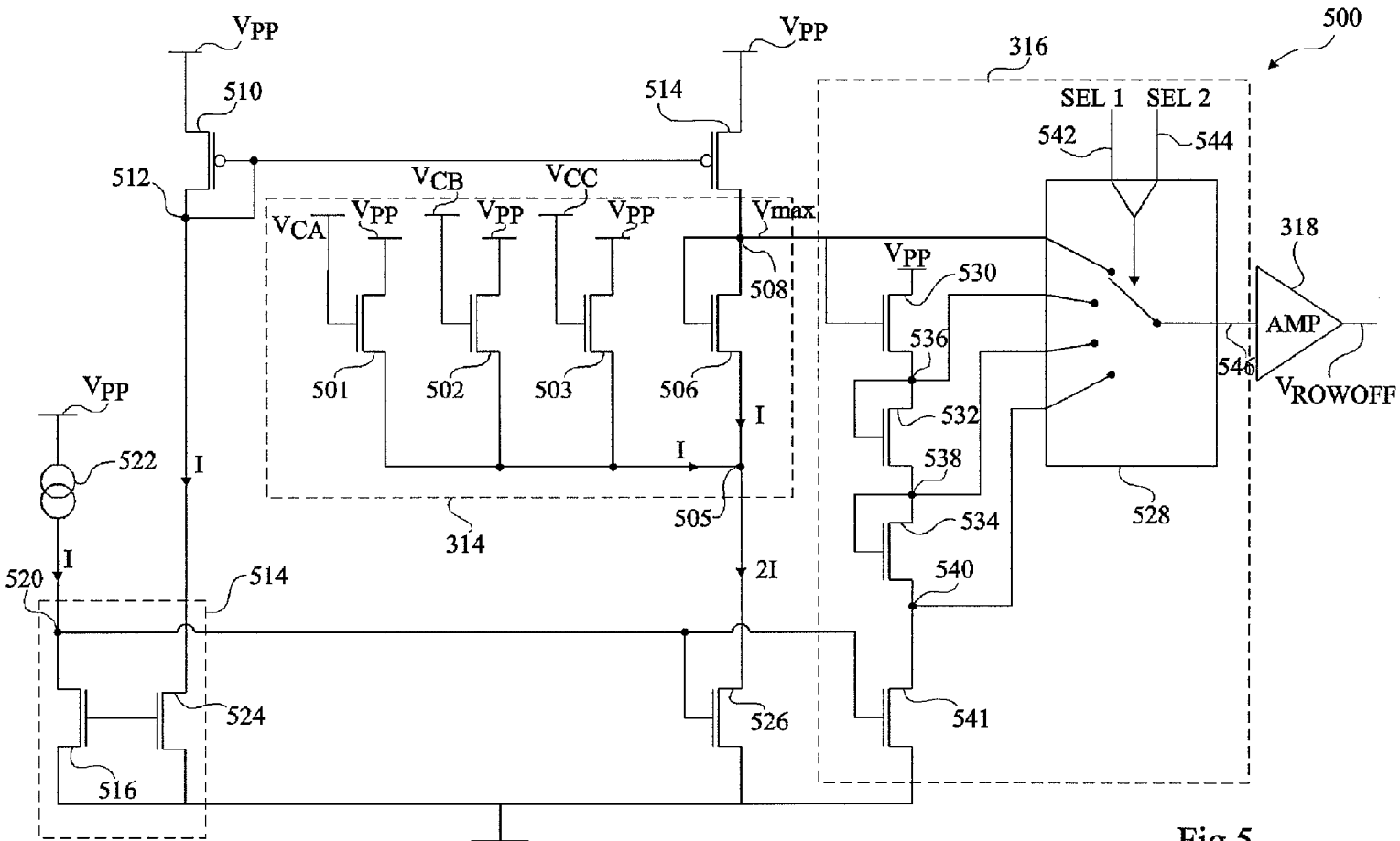
FIG. 5 illustrates the max voltage generation block, the adjustment block and the amplifier block of FIG. 3 in more detail according to the first embodiment of the present invention.

FIG. 5 illustrates circuitry 500 for generating the rowoff voltage based on the captured voltages $V_{CA}$, $V_{CB}$ and $V_{CC}$ stored by the circuitry of FIG. 4. In particular, circuitry 314 corresponds to the maximum voltage generation block 314 of FIG. 3 and provides the maximum voltage of the three captured voltages, whilst circuitry 316 corresponds to the adjustment circuit block 316 of FIG. 3, and adjusts the maximum value before this is provided to the amplifier 318 which provides the rowoff voltage.

Circuitry 314 comprises three MOSFET transistors 501, 502 and 503, each connected between the supply voltage $V_{PP}$ and a node 505 via their main current terminals. The gate terminals of MOSFETs 501, 502 and 503 are connected to the sampled voltage values $V_{CA}$, $V_{CB}$ and $V_{CC}$ respectively. The voltage at node 505 is the maximum voltage at any of nodes $V_{CA}$, $V_{CB}$ and $V_{CC}$, minus a gate source voltage VGS.

Node 505 is connected to the source terminal of a further transistor 506. The drain and gate terminals of transistor 506 are connected to a node 508, and transistor 506 serves to add a gate source voltage VGS to the voltage value at node 505 bringing this voltage back up to the level of the maximum voltage of voltages $V_{CA}$, $V_{CB}$ and $V_{CC}$.

First and second current mirrors are provided for controlling the current I through transistor 506.

The first current mirror comprises a reference branch and a second branch, the reference branch comprising a transistor 510 having a first main current terminal connected to the supply voltage $V_{PP}$ and a second main current terminal and a gate terminal connected to a node 512. The second branch of the first current mirror comprises a MOSFET 514, which has its first and second main current terminals connected to the supply voltage $V_{PP}$ and node 508, respectively. The gate terminal of transistor 514 is connected to the gate terminal of transistor 510.

The second current mirror comprises a reference branch, and second, third and fourth branches. The reference branch comprises a first reference transistor 516 connected via its main current terminals between a node 520 and ground. Node 520 is connected to the supply voltage $V_{PP}$ via a reference current source 522, and to the gate terminal of transistor 516. The second branch comprises a transistor 524 connected via its main current terminals between the second main current terminal of transistor 510 at node 512 and ground. The gate terminal of transistor 524 is also connected to node 520. A third branch of the second current mirror comprises a transistor 526 connected via its main current terminals between node 505 and ground. The gate terminal of transistor 526 is connected to node 520. The fourth branch is connected to the adjustment circuit block 316 as be described in more detail below.

Adjustment circuit block 316 comprises a multiplexer 528 and first, second and third MOSFET transistors 530, 532 and 534. The first transistor 530 is connected between the supply voltage $V_{PP}$ and a node 536 via its main current terminals. The second transistor 532 is connected via its main current terminals between node 536 and a further node 538. The third transistor 534 is connected between node 538 and a further node 540 via its main current terminals. The gate terminals of the first, second and third transistors 530, 532 and 534 are connected to nodes 508, 536, and 538 respectively.

The three MOSFETs 530, 532, 534 are used to reduce the maximum voltage Vmax by one, two or three gate-source voltages (VGS). In alternative embodiments this function could be provided by replacing MOSFETs by resistors or other suitable devices permitting the generation of a voltage offset.

Node 540 is connected to the fourth current mirror branch of the second current mirror, which comprises a MOSFET transistor 541 connected via its main current terminals between node 540 and ground. The gate terminal of transistor 541 is connected to node 520.

The first, second and third transistors 530, 532 and 534 are equivalent to a resistance network, the voltage at node 536 being equal to $V_{max}$ minus one gate source voltage VGS, the voltage at node 538 equal to $V_{max}$ minus two gate source voltages VGS, and the voltage at node 540 equal to $V_{max}$ minus three gate source voltages VGS. Nodes 508, 536, 538 and 540 are connected to first, second, third and fourth inputs to multiplexer 528. Multiplexer 528 also receives two selection input signals SEL1 and SEL2 on lines 542 and 544 respectively. Based on these selection inputs, one of the values at the four input lines is selected for output on an output line 546 from multiplexer 528. Thus either $V_{max}$, or $V_{max}$ minus one, two or three gate source voltages VGS can be selected for output on line 546 of multiplexer 528.

Output line 546 is connected to amplifier 318, which amplifies this output signal to provide the voltage value $V_{rowoff}$. Amplifier 318 is preferably a unitary amplifier having a high input impedance and low output impedance, such as an operational amplifier.

According to the present embodiment, the generated rowoff voltage is stored and directly applied to line 258, such that it is supplied to the rows of the display matrix 200 that are to be switched off. Switches 412 to 416 are for example controlled to provide new sampled values every time a new row is activated, such that the rowoff voltage is refreshed at the same rate that rows are refreshed. Rowoff amplifier 318 is preferably provided with a relatively large tank capacitor to smooth any abrupt changes in the sampled voltages. In alternative embodiments switches 412, 414, 416 can be controlled to sample more often than this, or less often. The optimal sampling period will depend on the particular display matrix, and this, along with the offset voltage, can be tuned to ensure that the value provided is always high enough to guarantee a reverse biasing of the pixels in the off state.

The rowoff voltage is preferably equal to the maximum column voltage $V_{max}$, minus the threshold voltage of a diode, as this is the smallest voltage possible whilst ensuring that all the diodes in a row are always switched off. Assuming that a diode threshold voltage is approximately equal to the gate source voltage VGS of a MOSFET transistor, this will correspond to selecting the voltage at the second input of multiplexer 528 for output, in other words the voltage at node 536. However, in practice a slightly higher or lower voltage level may be necessary and/or preferable, and thus the voltage offsetting means provided by the first, second and third transistors 530, 532 and 534 allow different voltage values to be selected.

It will be apparent that whilst a maximum column voltage $V_C$ is determined for each color, and then a maximum of these voltages is determined using circuitry 314 shown in FIG. 5, in alternative embodiments lines 406, 408 and 410 of FIG. 4 could be connected together, and a single sampling switch and capacitor provided for sampling and storing the voltage on this line, which would directly represent the maximum column voltage for all the columns of the display matrix. This value then could be provided as $V_{max}$ directly to the adjustment circuitry 316 of FIG. 5, at node 508.

However, in alternative embodiments, the maximum column voltages $V_{CA}$, $V_{CB}$ and $V_{CC}$ could be used for generating first, second and third independent variable rowoff voltages, one for the columns of each color. This would require a display matrix having separate row lines for the diodes of each color, such that a different rowoff voltage could be applied for each. This would be particularly advantageous for display matrixes in which the column voltages for different colors vary significantly, and thus the rowoff voltage could be further reduced for some colored diodes, improving their lifespan. In such an embodiment, the adjustment circuitry 316 is duplicated three times, once for each color, and instead of $V_{max}$, the column voltages $V_{CA}$, $V_{CB}$ and $V_{CC}$ are provided to respective ones of these adjustment circuits. Each adjustment circuit can then be connected to a respective amplifier for providing a rowoff voltage for each colored diode.

Figure 6:
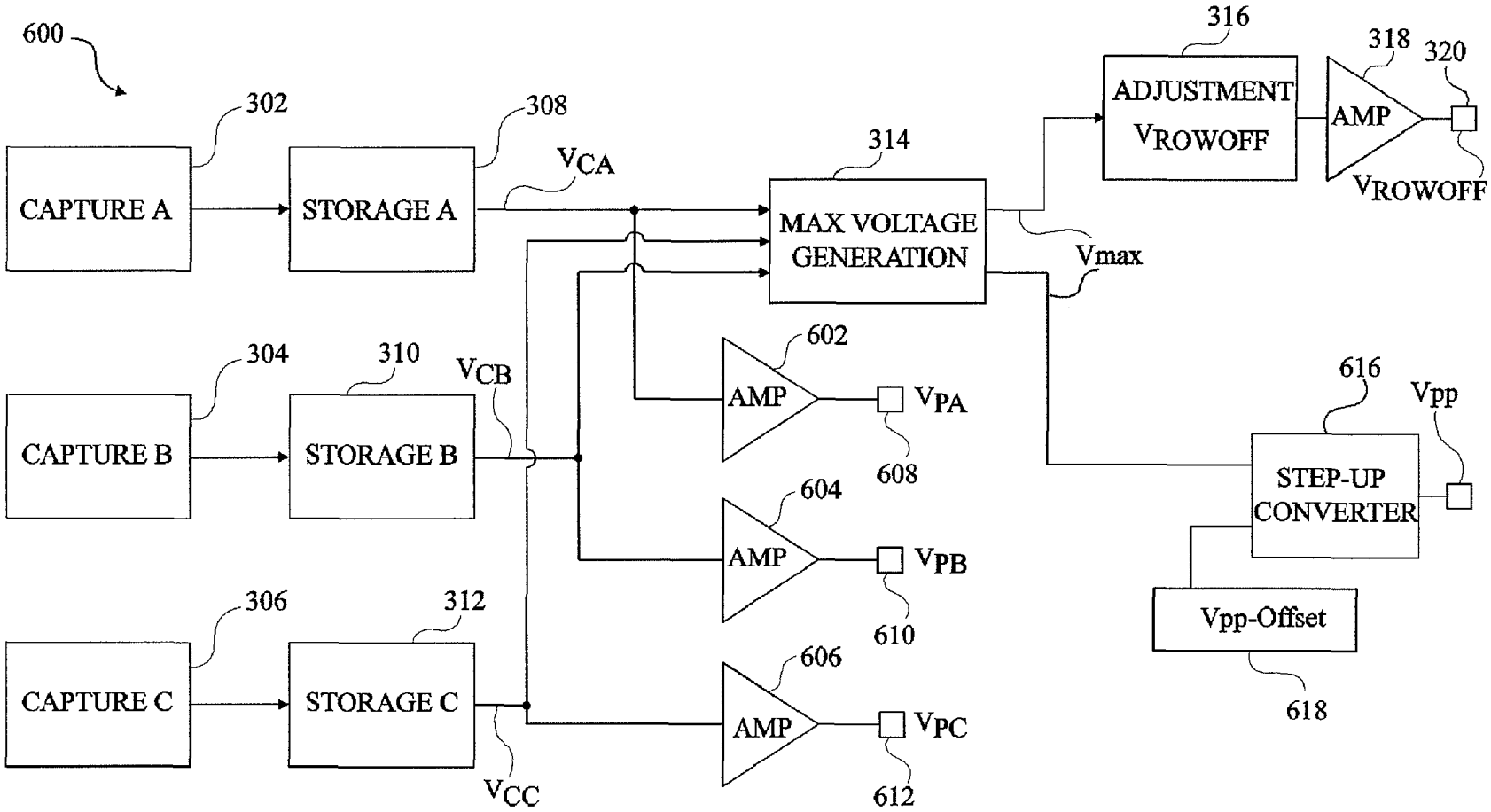
FIG. 6 illustrates circuitry for generating a rowoff voltage, a supply voltage $V_{PP}$, and a precharge voltage according to a second embodiment of the present invention.

FIG. 6 illustrates circuitry 600 for generating the voltage value $V_{rowoff}$, as well as the supply voltage level $V_{PP}$, and the precharge voltages $V_{PA}$, $V_{PB}$ and $V_{PC}$ for precharging the columns of each color. In this circuit, the maximum sampled column voltages $V_{CA}$, $V_{CB}$ and $V_{CB}$ are advantageously used for generating all three voltages. Thus the capture blocks 302, 304 and 306, and the storage means 308, 310 and 312 of FIG. 6 are the same blocks described in the embodiment of FIG. 4, and will not be described again in detail. Furthermore, the same maximum voltage generation block 314, adjustment circuit 316 and amplifier 318 are used to generate the rowoff voltage, and these will not be described again in detail.

The supply voltage level $V_{PP}$ is generated based on the output of the maximum voltage generation block 314. This output $V_{max}$ is provided to a step-up converter 616. Step-up converter 616 is for example a DC-DC converter that compares $V_{max}$ with a feedback value equal to Vpp-offset, provided by block 618. In order to conserve power, the supply voltage level $V_{PP}$ is preferably no higher than it need be. With reference to FIG. 4, the supply voltage $V_{PP}$ needs to be at least equal to the maximum voltage at any of the column nodes $C_N$, plus the source-drain voltage VDS necessary across transistors Q and R to ensure that these transistors operate correctly. The latter voltage is, for example, approximately 1 volt per transistor, and thus $V_{PP}$ is preferably 2 Volts higher than the maximum column voltage. The offset value is then equal to 2 Volts, and thus the feedback value provided at block 618 is equal to the current value of $V_{PP}$, minus 2 Volts. The value of $V_{PP}$ is thereby altered by step-up converter 616 until $V_{PP}$ is equal to $V_{max}$ plus 2 Volts.

The precharge voltage values $V_{PA}$, $V_{PB}$ and $V_{PC}$ are preferably generated by taking the maximum column voltages $V_{CA}$, $V_{CB}$ and $V_{CC}$ stored by capacitors 418, 420 and 422 respectively, and directly providing these values to respective amplifiers 602, 604 and 606 to provide the precharge voltages $V_{PA}$, $V_{PB}$ and $V_{PC}$ at nodes 608, 610 and 612 respectively. Amplifiers 602 to 606 are preferably unitary amplifiers having a high input impedance and low output impedance, for example operational amplifiers.

With reference to FIGS. 2 and 6, the three precharge voltages $V_{PA}$, $V_{PB}$ and $V_{PC}$, the supply voltage $V_{PP}$ as well as the rowoff voltage $V_{rowoff}$ can therefore all be generated based on the same maximum column voltage values $V_{CA}$, $V_{CB}$ and $V_{CC}$, which are sampled and stored by common capture and storage circuit blocks 302 to 312.

Thus circuitry has been described for controlling a display matrix and in particular for generating a rowoff voltage by capturing a maximum value of a plurality of column voltages, storing the maximum column voltage and providing the rowoff voltage based on this maximum column voltage. This is advantageous in that the rowoff voltage is thus generated based on a recently detected column voltages, and these voltages will be close to the optimal rowoff voltage that ensures the diodes are off without reducing the lifespan of the diodes by applying a higher voltage than needed. Voltage offsetting circuitry is preferably provided to adjust the voltage value to the optimal value, by removing the diode threshold voltage. By providing a plurality of different possible rowoff voltages, the most appropriate voltage can be selected, for example by trial and error. This allows the rowoff voltage to be adapted to a particular display matrix.

Whilst a number of exemplary embodiments have been described above, it will be apparent that there are many variations and modifications that could be applied.

For example, whilst the circuitry has been described for generating a rowoff voltage for a display matrix having diodes of three different colors, similar circuitry can be used for generating a rowoff voltage for a monochrome display matrix, in which only one maximum column voltage need be captured and stored and provided directly to the adjustment circuitry.

Whilst examples of circuits have been provided comprising MOSFET transistors, in alternative embodiments different circuit components could be used, such as bi-polar transistors. The MOSFETs described in relation to the circuit of FIG. 4 are for example all P-channel MOSFETs. All of the MOSFETs in the circuit of FIG. 5 are for example N-channel MOSFETs, except for MOSFETs 510 and 514, which are for example P-channel MOSFETs. In alternative embodiments of the circuits of FIGS. 4 and 5, some of the N-channel MOSFETs could be interchanged for P-channel MOSFETs, or some of the P-channel MOSFETs could be interchanged for N-channel MOSFETs.

Whilst transistors have been used to provide the voltage offset means for adjusting the maximum voltage $V_{max}$ in order to generate the rowoff voltage level, in alternative embodiments a resistance network comprising a series of resistors, or alternative means, could be used to provide the voltage offset levels at the inputs of multiplexer 528.

Furthermore, alternative sample and hold circuits could be used in place of switches 412, 414, 416 and capacitors 418, 420, 422, such alternatives for example comprising more complex circuitry. Other circuits, which may be more complex are also possible for providing the same function as the transistors $T_x$, $U_x$ and $W_x$ of FIG. 4, and transistors 501, 502 and 503 of FIG. 5.

Having thus described at least one illustrative embodiment of the invention, various alterations, modifications and improvements will readily occur to those skilled in the art. Such alterations, modifications and improvements are intended to be within the scope of the invention. Accordingly, the foregoing description is by way of example only and is not intended to be limiting. The invention is limited only as defined in the following claims and the equivalent thereto.

The invention claimed is:

1. Circuitry for controlling a display matrix formed of light-emitting diodes arranged in rows and columns, diodes in each row being connected to common row lines, and diodes in each column being connected to common column lines, each of said column lines being selectively connected to a current source for providing a current to each of said column lines when said column line is selected, a column voltage being present at a column node of each column line while said column line is selected, each of said row lines being selectively connected to a rowoff voltage for turning off the diodes in that row, the circuitry comprising generating means for generating said rowoff voltage comprising:

capture circuitry arranged to capture a maximum value of the column voltages present at the column nodes of a plurality of selected column lines;

storage circuitry arranged to store said maximum column voltage; and output circuitry arranged to provide said rowoff voltage based on said maximum column voltage; and voltage offsetting circuitry arranged to offset said maximum column voltage to provide said rowoff voltage, wherein said voltage offsetting circuitry is arranged to produce at one time, based on a plurality of invariable offsets, a plurality of possible voltages, each being offset from said maximum column voltage by a different one of the invariable offsets, and comprises selecting circuitry for selecting one of said voltages to provide the rowoff voltage.

2. The circuitry of claim 1 wherein said capture circuitry is arranged to capture said maximum column voltage while a first one of said rows of diodes is activated.

3. The circuitry of claim 1 wherein said voltage offsetting circuitry is arranged to reduce said maximum column voltage by a value equal to or less than the threshold voltage of one of said diodes.

4. The circuitry of claim 1, wherein said voltage offsetting means comprises at least one transistor, a voltage difference across two terminals of said at least one transistor offsetting said maximum column voltage.

5. The circuitry of claim 1, wherein said capture circuitry and said storage circuitry are arranged to capture and store a first maximum column voltage at the column nodes of selected column lines of diodes of a first color, and second and third maximum column voltages at column nodes of selected columns lines of diodes of a second and third colors respectively, said circuitry further comprising maximum generation circuitry arranged to receive said first, second and third maximum column voltages and to output the maximum of said first, second and third maximum column voltages to said output circuitry.

6. The circuitry of claim 5 wherein each of said columns lines is arranged to be driven by a precharge voltage prior to being selected, wherein first, second and third precharge voltages are provided for columns of diodes of said first, second and third colors respectively, said circuitry further comprising precharge voltage output means for providing said first, second and third precharge voltages based on said first, second and third maximum column voltages respectively.

7. The circuitry of claim 1, further comprising supply voltage generation circuitry for generating a supply voltage level provided to said current sources, comprising output circuitry arranged to receive said maximum column voltage from said storage means and to provide said supply voltage level based on said maximum column voltage.

8. A method for controlling a display matrix formed of light-emitting diodes arranged in rows and columns, diodes in each row being connected to common row lines, and diodes in each column being connected to common column lines, each of said column lines being selectively connected to a current source for providing a current to each of said column lines when said column line is selected, a column voltage being present at a column node of each selected column line while said column line is selected, each of said row lines being selectively connected to a rowoff voltage for turning off the diodes in that row, the method comprising generating said rowoff voltage comprising:

capturing a maximum value of the column voltages present at the column nodes of selected column lines;

storing said maximum column voltage; and providing said rowoff voltage based on said maximum column voltage, the providing comprising generating at one time, based on a plurality of invariable offsets, a plurality of possible voltages by offsetting said maximum voltage by each of the plurality of plurality of invariable offsets, each possible voltage being offset from said maximum column voltage by a different invariable offset.

9. Apparatus for use with a display screen comprising a matrix of diodes organized into rows and columns, an apparatus for providing at least one rowoff voltage to the display screen, the display screen applying the at least one rowoff voltage to diodes to reverse bias the diodes so as to selectively disable rows of diodes during display of an image on the display screen, the apparatus comprising:

a control circuit to adjust the at least one rowoff voltage based on a maximum control voltage provided to diodes of the matrix and to provide the adjusted at least one rowoff voltage to the matrix, wherein the control circuit is configured to adjust the at least one rowoff voltage at least in part by altering a difference between the at least one rowoff voltage and the maximum control voltage, the maximum control voltage being a maximum voltage of control voltages provided to the diodes of the matrix to cause the diodes to generate light.

10. The apparatus of claim 9, where the control circuit forms at least a part of a row driver of the display screen.

11. The apparatus of claim 10, wherein the row driver is integrated into a same physical housing as the display screen.

12. The apparatus of claim 9, further comprising:

at least one monitoring circuit to monitor the control voltages provided to diodes of the matrix and to store at least one control voltage as possible maximum control voltages; and at least one circuit to provide the maximum control voltage to the control circuit based on a comparison of the possible maximum control voltages.

13. The apparatus of claim 12, wherein the matrix comprises red diodes, green diodes, and blue diodes, and wherein the at least one monitoring circuit is configured to monitor the control voltages and to store a maximum red control voltage that is a maximum control voltage provided to red diodes, to store a maximum green control voltage that is a maximum control voltage provided to green diodes, and to store a maximum blue control voltage that is a maximum control voltage provided to blue diodes.

14. The apparatus of claim 12, wherein the at least one monitoring circuit is configured to monitor the control voltages provided by column driving circuits of the display screen.

15. The apparatus of claim 9, wherein the at least one control circuit is configured to alter the difference between the at least one rowoff voltage and the maximum control voltage so as to make the at least one rowoff voltage substantially equal to the maximum control voltage.

16. A method for use with a display screen comprising a matrix of diodes organized into rows and columns, a method for providing at least one rowoff voltage to the display screen to selectively disable rows of diodes during display of an image on the display screen, the display screen applying the at least one rowoff voltage to diodes to reverse bias the diodes, the method comprising:

adjusting the at least one rowoff voltage based on a maximum control voltage provided to diodes of the matrix, wherein adjusting the at least one rowoff voltage comprises adjusting a difference between the at least one rowoff voltage and the maximum control voltage, the maximum control voltage being a maximum voltage of control voltages provided to the diodes of the matrix to cause the diodes to generate light; and providing the adjusted at least one rowoff voltage to the matrix.

17. The method of claim 16, further comprising:

monitoring the control voltages provided to diodes of the matrix;

storing at least one control voltage as possible maximum control voltages; and comparing the possible maximum control voltages to identify the maximum control voltage.

18. The method of claim 17, wherein the storing comprises storing a maximum red control voltage that is a maximum control voltage provided to red diodes, storing a maximum green control voltage that is a maximum control voltage provided to green diodes, and storing a maximum blue control voltage that is a maximum control voltage provided to blue diodes.

19. The method of claim 17, wherein monitoring the control voltages comprises monitoring control voltages provided by one or more column drivers of the display screen.

20. The method of claim 16, wherein adjusting the difference between the at least one rowoff voltage and the maximum control voltage comprises making the at least one rowoff voltage substantially equal to the maximum control voltage.

* * * * *